US007862390B2

(12) United States Patent
Copper

(10) Patent No.: US 7,862,390 B2
(45) Date of Patent: Jan. 4, 2011

(54) POWER UTILITY CONNECTOR WITH A PLURALITY OF CONDUCTOR RECEIVING CHANNELS

(75) Inventor: Charles Dudley Copper, Hummelstown, PA (US)

(73) Assignee: Tyco Electronics Corporation, Middletown, PA (US)

( * ) Notice: Subject to any disclaimer, the term of this patent is extended or adjusted under 35 U.S.C. 154(b) by 433 days.

(21) Appl. No.: 11/804,122

(22) Filed: May 16, 2007

(65) Prior Publication Data

US 2008/0283686 A1 Nov. 20, 2008

(51) Int. Cl.
*H01R 11/01* (2006.01)

(52) U.S. Cl. ..... 439/781; 439/783

(58) Field of Classification Search ..... 439/781, 439/782, 783, 785, 786, 787, 789, 790, 791, 439/792, 793, 794, 796, 797, 798, 801, 807, 439/815

See application file for complete search history.

(56) References Cited

U.S. PATENT DOCUMENTS

| | | | | |
|---|---|---|---|---|
| 2,097,470 | A | 11/1937 | Richardson | |
| 3,026,497 | A | 3/1962 | Myers et al. | |
| 3,088,993 | A | 5/1963 | Matthysse et al. | |
| 3,399,375 | A | 8/1968 | Peek | |
| 3,892,455 | A * | 7/1975 | Sotolongo | 439/100 |
| 3,924,920 | A | 12/1975 | Moscioni et al. | |
| 4,247,159 | A | 1/1981 | Fruchard | |
| 4,279,461 | A | 7/1981 | Bussen et al. | |
| 4,384,753 | A | 5/1983 | Mixon, Jr. | |
| 4,471,159 | A | 9/1984 | Frank, Jr. | |
| 4,684,196 | A | 8/1987 | Smith et al. | |
| 4,723,921 | A | 2/1988 | Pooley | |
| 4,764,131 | A | 8/1988 | Beinhaur | |
| 4,825,513 | A | 5/1989 | Verespej | |
| 4,857,020 | A | 8/1989 | Crosby | |

(Continued)

FOREIGN PATENT DOCUMENTS

CL 2202-1999 2/1999

(Continued)

OTHER PUBLICATIONS

Office Action dated Aug. 15, 2006 for U.S. Appl. No. 11/437,480; (8 pgs.).

(Continued)

*Primary Examiner*—Ross N Gushi

(57) ABSTRACT

An electrical connector assembly includes a main conductive member and a tap conductive member separately fabricated from one another. Each of the main and tap conductive members including at least one conductor receiving channel, wherein the main and tap conductive members together include at least three channels configured to receive conductors therein and extending along three different channel axes. The channel(s) of the main conductive member is configured to receive a main power line conductor, and the channel(s) of the tap conductive member is configured to receive a tap power line conductor. The main and tap conductive members are joined to one another such that the main conductive member and the tap conductive member cooperate to capture the main power line conductor therebetween when the main and tap conductive members are joined, and the tap conductive member and the main conductive member cooperate to capture the tap power line conductor therebetween when the main and tap conductive members are joined.

20 Claims, 6 Drawing Sheets

U.S. PATENT DOCUMENTS

| | | | | |
|---|---|---|---|---|
| 4,872,856 | A | 10/1989 | Pooley et al. | |
| 4,915,653 | A | 4/1990 | Mair | |
| 5,342,224 | A | 8/1994 | Lefavour | |
| 5,692,930 | A | 12/1997 | Garver et al. | |
| 5,704,816 | A | 1/1998 | Polidori | |
| 5,752,860 | A * | 5/1998 | Greaves | 439/781 |
| 6,004,165 | A | 12/1999 | Dinh et al. | |
| 6,086,406 | A | 7/2000 | Francois et al. | |
| 6,595,472 | B1 | 7/2003 | Pisczak | |
| 6,979,236 | B1 | 12/2005 | Stanton | |
| 7,182,653 | B1 * | 2/2007 | Hoxha | 439/783 |
| 7,309,263 | B2 | 12/2007 | Copper et al. | |
| 7,524,217 | B2 | 4/2009 | Copper | |
| 2001/0044990 | A1 | 11/2001 | Turvey et al. | |
| 2002/0142674 | A1 | 10/2002 | Chadbourne et al. | |
| 2007/0004289 | A1 | 1/2007 | Hoxha et al. | |

FOREIGN PATENT DOCUMENTS

| | | | |
|---|---|---|---|
| DE | 537210 | | 10/1931 |
| EP | 0342122 | | 11/1989 |
| ES | 2 121 543 | A1 | 11/1998 |
| FR | 1 309 042 | A | 2/1963 |

OTHER PUBLICATIONS

Final Office Action dated Jan. 18, 2007 for U.S. Appl. No. 11/437,480; (12 pgs.).
Office Action dated Oct. 29, 2007 for U.S. Appl. No. 11/804,065; (18 pgs.).
Final Office Action dated Feb. 28, 2008 for U.S. Appl. No. 11/930,713; (13 pgs.).
Office Action dated May 23, 2008 for U.S. Appl. No. 11/930,713; (9 pgs.).
Office Action dated Jun. 13, 2008 for U.S. Appl. No. 11/930,868; (16 pgs.).
Office Action dated Oct. 10, 2008 for U.S. Appl. No. 11/930,868; (12 pgs.).
Office Action dated Jan. 28, 2009 for U.S. Appl. No. 11/930,868; (10 pgs.).
Office Action dated May 17, 2010 for U.S. Appl. No. 12/509,246; (19 pgs.).
J.D. Sprecher, et al "Wedge-Connector Technology in Power Utility Applications"; AMP Journal of Technology, Jun. 1996, vol. 5, Tyco Electronics Corporation; (10 pgs.).

* cited by examiner

POWER UTILITY CONNECTOR WITH A PLURALITY OF CONDUCTOR RECEIVING CHANNELS

BACKGROUND OF THE INVENTION

This invention relates generally to electrical connectors, and more particularly, to power utility connectors for mechanically and electrically connecting a tap or distribution conductor to a main electrical transmission conductor.

Electrical utility firms constructing, operating and maintaining overhead and/or underground power distribution networks and systems utilize connectors to tap main power transmission conductors and feed electrical power to distribution line conductors, sometimes referred to as tap conductors. The main power line conductors and the tap conductors are typically high voltage cables that are relatively large in diameter, and the main power line conductor may be differently sized from the tap conductor, requiring specially designed connector components to adequately connect tap conductors to main power line conductors. Generally speaking, three types of connectors are commonly used for such purposes, namely bolt-on connectors, compression-type connectors, and wedge connectors.

Bolt-on connectors typically employ die-cast metal connector pieces or connector halves formed as mirror images of one another, sometimes referred to as clam shell connectors. Each of the connector halves defines opposing channels that axially receive the main power conductor and the tap conductor, respectively, and the connector halves are bolted to one another to clamp the metal connector pieces to the conductors. Such bolt-on connectors have been widely accepted in the industry primarily due to their ease of installation, but such connectors are not without disadvantages. A particular connector piece may have a channel having a given radius that accommodates a set, limited, range of conductor sizes. For example, one connector piece may accommodate a 1 gauge to a 4/0 or four nought gauge conductor, while another connector piece may accommodate a 6 gauge to a 2 gauge conductor. As a result, many connector pieces are needed to accommodate the full range of conductor sizes that may be encountered in the field. Due to the limited range taking ability of known bolt-on connectors, the part count needed is increased, which increases the overall cost of the bolt-on connector system.

Compression connectors, instead of utilizing separate connector pieces, may include a single metal piece connector that is bent or deformed around the main power conductor and the tap conductor to clamp them to one another. Such compression connectors are generally available at a lower cost than bolt-on connectors, but are more difficult to install. Hand tools are often utilized to bend the connector around the cables, and because the quality of the connection is dependent upon the relative strength and skill of the installer, widely varying quality of connections may result. Poorly installed or improperly installed compression connectors can present reliability issues in power distribution systems.

Wedge connectors are also known that include a C-shaped channel member that hooks over the main power conductor and the tap conductor, and a wedge member having channels in its opposing sides is driven through the C-shaped member, deflecting the ends of the C-shaped member and clamping the conductors between the channels in the wedge member and the ends of the C-shaped member. One such wedge connector is commercially available from Tyco Electronics Corporation of Harrisburg, Pa. and is known as an AMPACT Tap or Stirrup Connector. AMPACT connectors include different sized channel members to accommodate a set range of conductor sizes, and multiple wedge sizes for each channel member. Each wedge accommodates a different conductor size. As a result, AMPACT connectors tend to be expensive due to the increased part count. For example, a user may be required to possess three channel members that accommodate a full range of conductor sizes. Additionally, each channel member may require up to five wedge members to accommodate each conductor size for the corresponding channel member. As such, the user must carry fifteen connector pieces in the field to accommodate the full range of conductor sizes. The increased part count increases the overall expense and complexity of the AMPACT connectors.

AMPACT connectors are believed to provide superior performance over bolt-on and compression connectors. For example, the AMPACT connector results in a wiping contact surface that, unlike bolt-on and compression connectors, is stable, repeatable, and consistently applied to the conductors, and the quality of the mechanical and electrical connection is not as dependent on torque requirements and/or relative skill of the installer. Additionally, and unlike bolt-on or compression connectors, because of the deflection of the ends of the C-shaped member some elastic range is present wherein the ends of the C-shaped member may spring back and compensate for relative compressible deformation or movement of the conductors with respect to the wedge and/or the C-shaped member.

It would be desirable to provide a lower cost, more universally applicable alternative to conventional power utility connectors.

BRIEF DESCRIPTION OF THE INVENTION

In one aspect, an electrical connector assembly is provided including a main conductive member and a tap conductive member separately fabricated from one another. Each of the main and tap conductive members including at least one conductor receiving channel, wherein the main and tap conductive members together include at least three channels configured to receive conductors therein and extending along three different channel axes. The channel(s) of the main conductive member is configured to receive a main power line conductor, and the channel(s) of the tap conductive member is configured to receive a tap power line conductor. The main and tap conductive members are joined to one another such that the main conductive member and the tap conductive member cooperate to capture the main power line conductor therebetween when the main and tap conductive members are joined, and the tap conductive member and the main conductive member cooperate to capture the tap power line conductor therebetween when the main and tap conductive members are joined.

Optionally, each of the main and tap conductive members may include first and second arms, wherein each first arm has at least one of the channels therein. The first arm of the main conductive member and the second arm of the tap conductive member may cooperate to capture the main power line conductor when the main and tap conductive members are joined, and the first arm of the tap conductive member and the second arm of the main conductive member may cooperate to capture the tap power line conductor when the main and tap conductive members are joined. Optionally, a fastener may join the main and tap conductive members to one another. Optionally, each channel may be adapted to engage conductors having a range of sizes.

In another aspect, an electrical connector assembly is provided for power utility transmission conductors, wherein the assembly includes a first conductive member and a second conductive member separately fabricated from one another and cooperating to interconnect main and tap conductors. Each of the first and second conductive members includes a wedge portion and a deflectable channel portion extending from the wedge portion. The channel portion of the first conductive member has a plurality of differently sized conductor receiving channels configured for receiving the main conductor or the tap conductor, wherein one of the channels is selected to receive the conductor based on the diameter of the conductor. The channel portion of the second conductive member has a conductor receiving channel configured for receiving the other of the main or tap conductors. A fastener joins the main and tap conductive members to one another.

In yet another aspect, an electrical connector assembly is provided for power utility transmission conductors, wherein the assembly includes a first conductive member having a mating side generally facing a second conductive member. The first conductive member includes a plurality of channels extending along the mating side, wherein the plurality of channels are oriented along at least three different channel axes. The second conductive member having a mating side generally facing the mating side of the first conductive member. The second conductive member includes a plurality of channels extending along the mating side, wherein the plurality of channels are oriented along at least three different channel axes. A fastener joins the first and second conductive members to one another. The mating sides face one another, and the channels of the first conductive member are aligned with the channels of the second conductive member, when the first and second conductive members are joined.

DETAILED DESCRIPTION OF THE INVENTION

Figure 1:
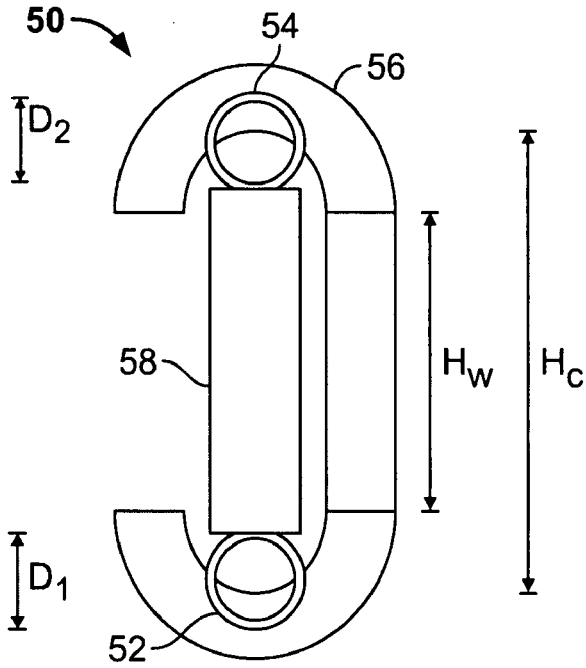
FIG. 1 (Prior Art)
FIG. 1 is a side elevational view of a known wedge connector assembly.
Figure 2:
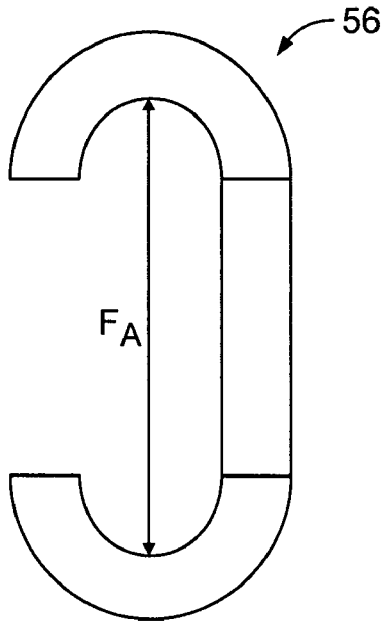
FIG. 2 (Prior Art)
FIG. 2 is a side elevational view of a portion of the assembly shown in FIG. 1.

FIGS. 1 and 2 illustrate a known wedge connector assembly 50 for power utility applications wherein mechanical and electrical connections between a tap or distribution conductor 52 and a main power conductor 54 are to be established. The connector assembly 50 includes a C-shaped spring member 56 and a wedge member 58. The spring member 56 hooks over the main power conductor 54 and the tap conductor 52, and the wedge member 58 is driven through the spring member 56 to clamp the conductors 52, 54 between the ends of the wedge member 58 and the ends of the spring member 56.

The wedge member 58 may be installed with special tooling having for example, gunpowder packed cartridges, and as the wedge member 58 is forced into the spring member 56, the ends of the spring member 56 are deflected outwardly and away from one another via the applied force $F_A$ shown in FIG. 2. Typically, the wedge member 58 is fully driven to a final position wherein the rear end of the wedge member 58 is substantially aligned with the rear edge of the spring member 56. The amount of deflection of the ends of the spring member 56 is determined by the size of the conductors 52 and 54. For example, the deflection is greater for the larger diameter conductors 52 and 54.

As shown in FIG. 1, the wedge member 58 has a height $H_W$, while the spring member 56 has a height $H_C$ between opposing ends of the spring member 56 where the conductors 52, 54 are received. The tap conductor 52 has a first diameter $D_1$ and the main conductor 54 has a second diameter $D_2$ that may be the same or different from $D_1$. As is evident from FIG. 1, $H_W$ and $H_C$ are selected to produce interference between each end of the spring member 56 and the respective conductor 52, 54. Specifically, the interference I is established by the relationship:

$$I=H_W+D_1+D_2-H_C \tag{1}$$

With strategic selection of $H_W$ and $H_C$ the actual interference I achieved may be varied for different diameters $D_1$ and $D_2$ of the conductors 52 and 54. Alternatively, $H_W$ and $H_C$ may be selected to produce a desired amount of interference I for various diameters $D_1$ and $D_2$ of the conductors 52 and 54. For example, for larger diameters $D_1$ and $D_2$ of the conductors 52 and 54, a smaller wedge member 58 having a reduced height $H_W$ may be selected. Alternatively, a larger spring member 56 having an increased height $H_C$ may be selected to accommodate the larger diameters $D_1$ and $D_2$ of the conductors 52 and 54. As a result, a user requires multiple sized wedge members 52 and/or spring members 56 in the field to accommodate a full range of diameters $D_1$ and $D_2$ of the conductors 52 and 54. Consistent generation of at least a minimum amount of interference I results in a consistent application of applied force $F_A$ which will now be explained in relation to FIG. 3.

Figure 3:
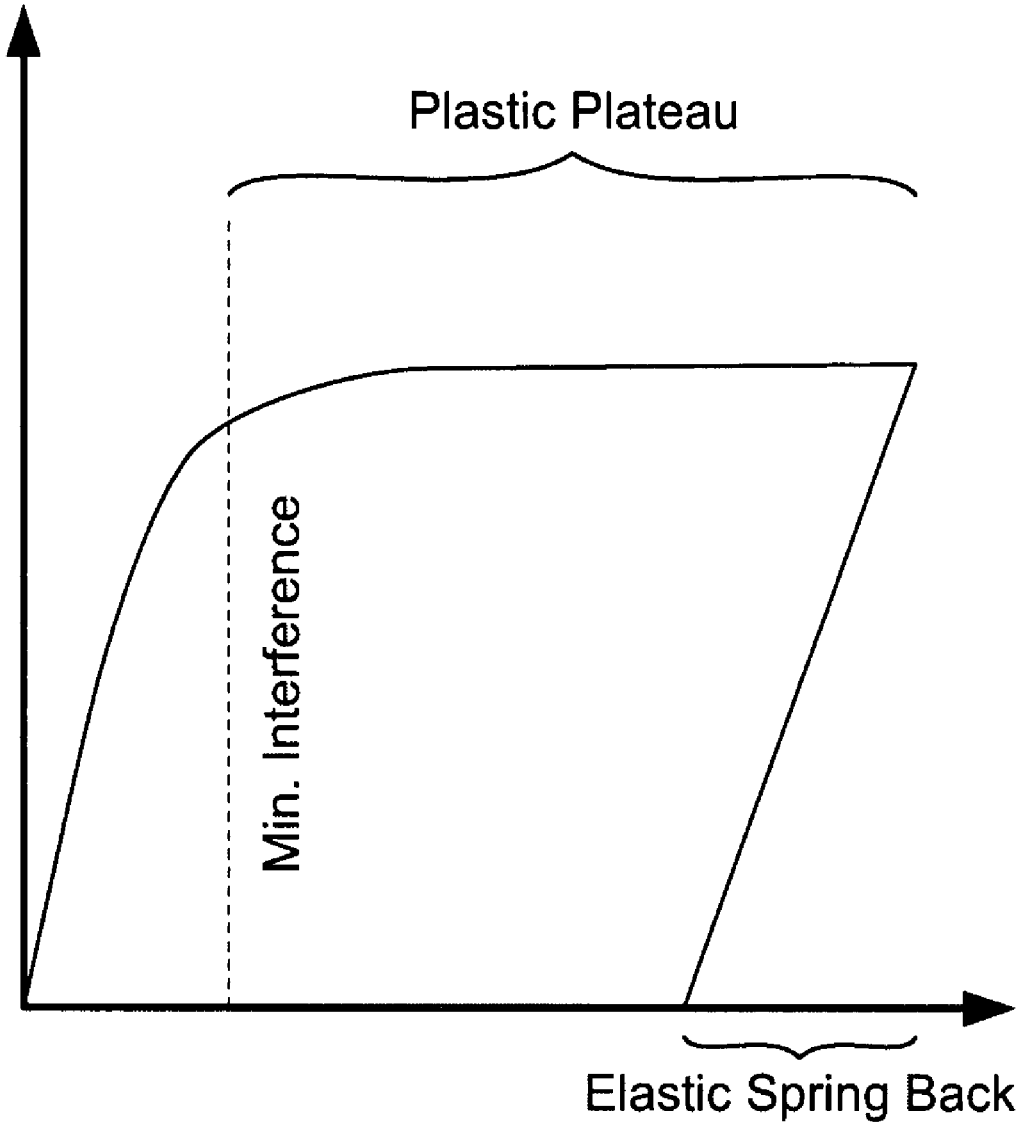
FIG. 3 is a force/displacement graph for the assembly shown in FIG. 1.

FIG. 3 illustrates an exemplary force versus displacement curve for the assembly 50 shown in FIG. 1. The vertical axis represents the applied force and the horizontal axis represents displacement of the ends of the spring member 56 as the wedge member 58 is driven into engagement with the conductors 52, 54 and the spring member 56. As FIG. 3 demonstrates, a minimum amount of interference, indicated in FIG. 3 with a vertical dashed line, results in plastic deformation of the spring member 56 that, in turn, provides a consistent clamping force on the conductors 52 and 54, indicated by the plastic plateau in FIG. 3. The plastic and elastic behavior of the spring member 56 is believed to provide repeatability in clamping force on the conductors 52 and 54 that is not possible with known bolt-on connectors or compression connectors. However, the need for a large inventory of differently sized spring members 56 and wedge members 58 renders the connector assembly 50 more expensive and less convenient than some user's desire.

Figure 4:
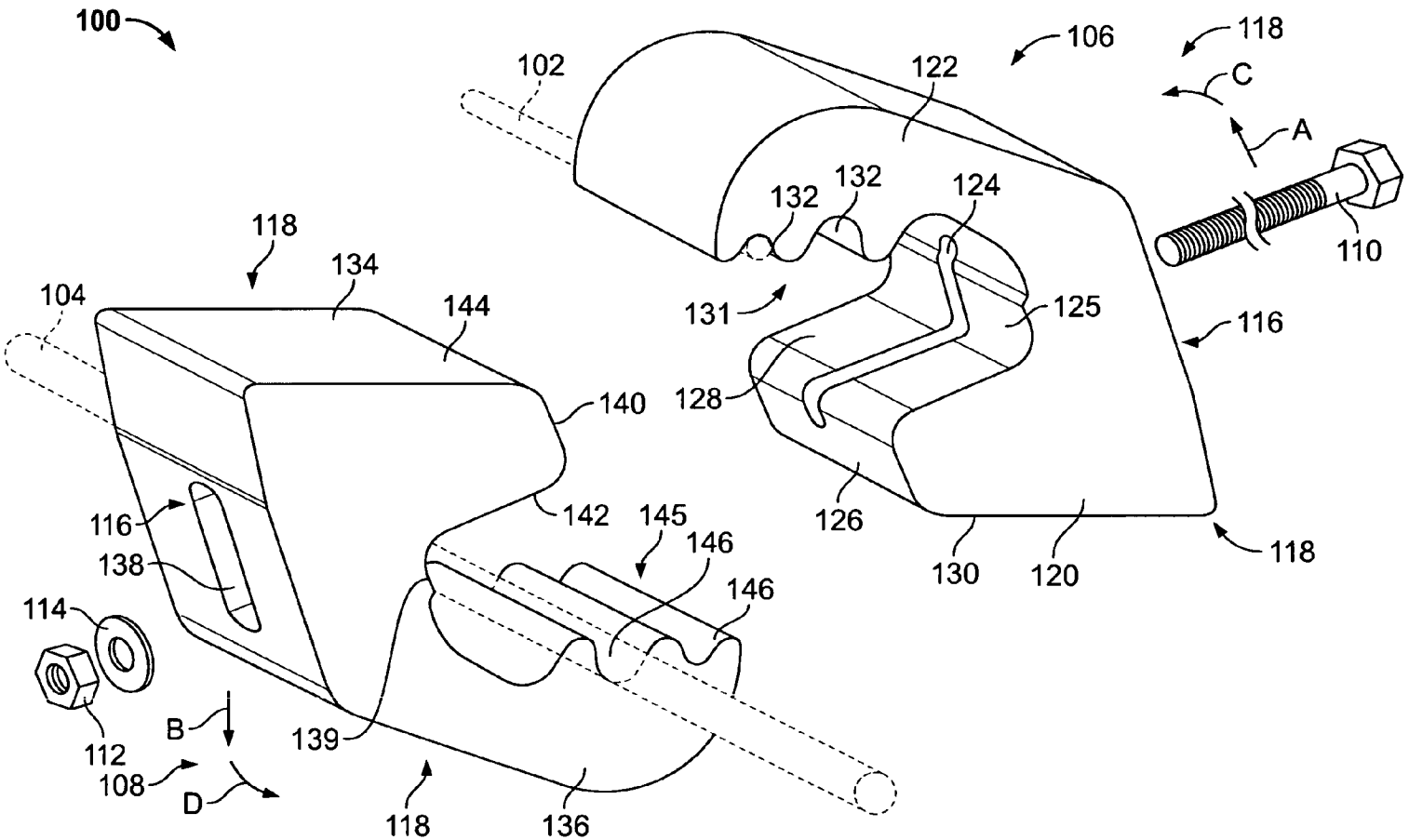
FIG. 4 illustrates a connector assembly in an unmated position and formed in accordance with an exemplary embodiment.

FIG. 4 is an exploded view of a connector assembly 100 formed in accordance with an exemplary embodiment and that overcomes these and other disadvantages. The connector assembly 100 is adapted for use as a tap connector for connecting a tap conductor 102 (shown in phantom in FIG. 4), to a main conductor 104 (also shown in FIG. 4) of a utility power distribution system. As explained in detail below, the connector assembly 100 provides superior performance and reliability to known bolt-on and compression connectors, while providing ease of installation and greater range taking capability to known connector assemblies.

The tap conductor 102, sometimes referred to as a distribution conductor, may be a known high voltage cable or line having a generally cylindrical form in an exemplary embodiment. The main conductor 104 may also be a generally cylindrical high voltage cable line. The tap conductor 102 and the main conductor 104 may be of the same wire gage or different wire gage in different applications and the connector assembly 100 is adapted to accommodate a range of wire gages for each of the tap conductor 102 and the main conductor 104.

When installed to the tap conductor 102 and the main conductor 104, the connector assembly 100 provides electrical connectivity between the main conductor 104 and the tap conductor 102 to feed electrical power from the main conductor 104 to the tap conductor 102 in, for example, an electrical utility power distribution system. The power distribution system may include a number of main conductors 104 of the same or different wire gage, and a number of tap conductors 102 of the same or different wire gage. The connector assembly 100 may be used to provide tap connections between main conductors 104 and tap conductors 102 in the manner explained below.

As shown in FIG. 4, the connector assembly 100 includes a tap conductive member 106, a main conductive member 108, and a fastener 110 that couples the tap conductive member 106 and the main conductive member 108 to one another. In an exemplary embodiment, the fastener 110 is a threaded member inserted through the respective conductive members 106 and 108, and a nut 112 and lock washer 114 are provided to engage an end of the fastener 110 when the conductive members 106 and 108 are assembled. While specific fastener elements 110, 112 and 114 are illustrated in FIG. 1, it is understood that other known fasteners may alternatively be used if desired. Each of the conductive members 106, 108 generally include a central body portion 116 and arms 118 that extend outward from the body portion 116. Optionally, the arms 118 may be substantially identically formed, however, in the illustrated embodiment, the arms 118 are differently sized and shaped.

In the illustrated embodiment, the tap conductive member 106 includes a wedge portion 120 and a channel portion 122 extending from the wedge portion 120. The channel portion 122 defines a first of the arms 118 and the wedge portion 120 defines a second of the arms 118 for the tap conductive member 106. A fastener bore 124 is formed in and extends through at least a portion of the body portion 116. The fastener bore 124 may also be formed in and extend through at least a portion of wedge portion 120. In an exemplary embodiment, the body portion 116 also defines a displacement stop 125 proximate the wedge portion 120. The main conductive member 108 engages the displacement stop 125 when the connector assembly is fully assembled, as described in further detail below.

The wedge portion 120 includes an abutment face 126, a wiping contact surface 128, and a conductor contact surface 130. The wiping contact surface 128 is angled with respect to the abutment face 126 and a rounded edge may define a transition between the abutment face 126 and the wiping contact surface 128. The conductor contact surface 130 extends substantially perpendicular to the abutment face 126 and obliquely with respect to the wiping contact surface 128. The conductor contact surface 130 generally faces a portion of the main conductive member 108 and engages and captures the main conductor 104 therebetween during assembly of the connector assembly 100.

The channel portion 122 extends away from the wedge portion 120 and includes a mating interface 131 that generally faces the wedge portions 120. A plurality of channels 132 are positioned along the mating interface 131. The channels 132 are adapted to receive the tap conductor 102 at a spaced relation from the wedge portion 120. The channel portion 122 is reminiscent of a hook in one embodiment, and the wedge portion 120 and the channel portion 122 together have a generally C-shaped body. The tap conductive member 106 may be integrally formed and fabricated from extruded metal, together with the wedge and channel portions 120, 122 in a relatively straightforward and low cost manner.

In an exemplary embodiment, because the connector assembly 100 is used to interconnect a single tap conductor 102 with a single main conductor 104, the tap conductor 102 is received in only one of the plurality of channels 132. The selection of the channel 132 that receives the tap conductor 102 depends on the size and shape of the channel 132 and/or the size and shape of the tap conductor 102. While two channels 132 are illustrated in FIG. 4, it is realized that any number of channels 132 may be provided in alternative embodiments. The channel 132 is sized and shaped to cradle the tap conductor 102 and hold the tap conductor 102 in position during assembly of the connector assembly 100. In an exemplary embodiment, the channels 132 are sized and/or shaped differently than one another to accommodate different sized and/or shaped tap conductors 102. Each channel 132 includes an open side that receives the tap conductor 102 and exposes at least a portion of the tap conductor 102. For example, the channel 132 may wrap around the tap conductor 102 for about 180 circumferential degrees in an exemplary embodiment, and may expose about 180 circumferential degrees of the tap conductor 102. The open side of each channel 132 lies along the mating interface 131 and generally faces toward the wedge portion 120.

In the illustrated embodiment, the main conductive member 108 likewise includes a wedge portion 134 and a channel portion 136 extending from the wedge portion 134. The channel portion 136 defines a first of the arms 118 and the wedge portion 134 defines a second of the arms 118 for the main conductive member 108. A fastener bore 138 is formed in and extends through at least a portion of the body portion 116. The fastener bore 138 may also be formed in and extend through at least a portion of wedge portion 134. In an exemplary embodiment, the body portion 116 also defines a displacement stop 139 proximate the wedge portion 134. The wedge portion 120 of the tap conductive member 108 engages the displacement stop 139 when the connector assembly is fully assembled, as described in further detail below.

The wedge portion 134 includes an abutment face 140, a wiping contact surface 142, and a conductor contact surface 144. The wiping contact surface 142 is angled with respect to the abutment face 140 and a rounded edge may define a transition between the abutment face 140 and the wiping contact surface 142. The conductor contact surface 144 extends substantially perpendicular to the abutment face 140 and obliquely with respect to the wiping contact surface 142. The conductor contact surface 144 generally faces the channel portion 122 of the tap conductive member 106 and engages and captures the tap conductor 102 therebetween during assembly of the connector assembly 100.

The channel portion 136 extends away from the wedge portion 134 and includes a mating interface 145 that generally faces the wedge portions 120. A plurality of channels 146 are positioned along the mating interface 145. The channels 146 are adapted to receive the main conductor 104 at a spaced relation from the wedge portion 134. The channel portion 136 is reminiscent of a hook in one embodiment, and the wedge portion 134 and the channel portion 136 together have a generally C-shaped body. The main conductive member 108 may be integrally formed and fabricated from extruded metal, together with the wedge and channel portions 134, 136 in a relatively straightforward and low cost manner.

In an exemplary embodiment, because the connector assembly 100 is used to interconnect a single tap conductor 102 with a single main conductor 104, the main conductor 104 is received in only one of the plurality of channels 146. The selection of the channel 146 that receives the main conductor 104 depends on the size and shape of the channel 146 and/or the size and shape of the main conductor 104. While two channels 146 are illustrated in FIG. 4, it is realized that any number of channels 146 may be provided in alternative embodiments. The number of channels 146 may be the same as, or may be different than, the number of channels 132. Each channel 146 is sized and shaped to cradle the main conductor 104 and hold the main conductor 104 in position during assembly of the connector assembly 100. In an exemplary embodiment, the channels 146 are sized and/or shaped differently than one another to accommodate different sized and/or shaped main conductors 104. Each channel 146 includes an open side that receives the main conductor 104 and exposes at least a portion of the main conductor 104. For example, the channels 146 may wrap around the main conductor 104 for about 180 circumferential degrees in an exemplary embodiment, and may expose about 180 circumferential degrees of the main conductor 104. The open side of each channel 146 lies along the mating interface 145 and generally faces toward the wedge portion 134.

The tap conductive member 106 and the main conductive member 108 are separately fabricated from one another or otherwise formed into discrete connector components and are assembled to one another as explained below. While one exemplary shape of the tap and main conductive members 106, 108 has been described herein, it is recognized that the conductive members 106, 108 may be alternatively shaped in other embodiments as desired.

In one embodiment, the wedge portions 120, 134 of the respective tap and the main conductive members 106, 108 are substantially identically formed and share the same geometric profile and dimensions to facilitate interfitting of the wedge portions 120, 134, in the manner explained below, as the conductive members 106, 108 are mated. Identical formation of the wedge portions 120, 134 provides for mixing and matching of conductive members 106, 108 for differently sized conductors 102, 104 while achieving a repeatable and reliable connecting interface via the wedge portions 120, 134. The channel portions 122, 136 of the conductive members 106 and 108, however, may be differently dimensioned as appropriate to be engaged to differently sized conductors 102, 104 while maintaining substantially the same shape of the conductive members 106, 108. The channel portions 122, 136 may include differently sized and/or shaped channels 132, 146 relative to one another. Optionally, the channel portions 122, 136 may have substantially identical geometric profiles, but may include different sized and/or shaped channels 132, 146. Alternatively, the channel portions 122, 136 may have different geometric profiles to accommodate different sized or shaped channels 132, 146.

As shown in FIG. 4, prior to assembly, the tap conductive member 106 and the main conductive member 108 are generally inverted relative to one another with the respective wedge portions 120, 134 facing one another. The fastener bores 114, 138 are aligned with one another to facilitate extension of the fastener 110 therethrough. The channel portion 122 of the tap conductive member 106 extends away from the wedge portion 120 in a first direction, indicated by the arrow A, and the channel portion 136 of the main conductive member 108 extends from the wedge portion 134 in a second direction, indicated by arrow B that is opposite to the direction of arrow A. Additionally, the channel portion 122 of the tap conductive member 106 extends around the tap conductor 102 in a circumferential direction indicated by the arrow C, while the channel portion 136 of the main conductive member 108 extends circumferentially around the main conductor 104 in the direction of arrow D that is opposite to arrow C.

Figure 5:
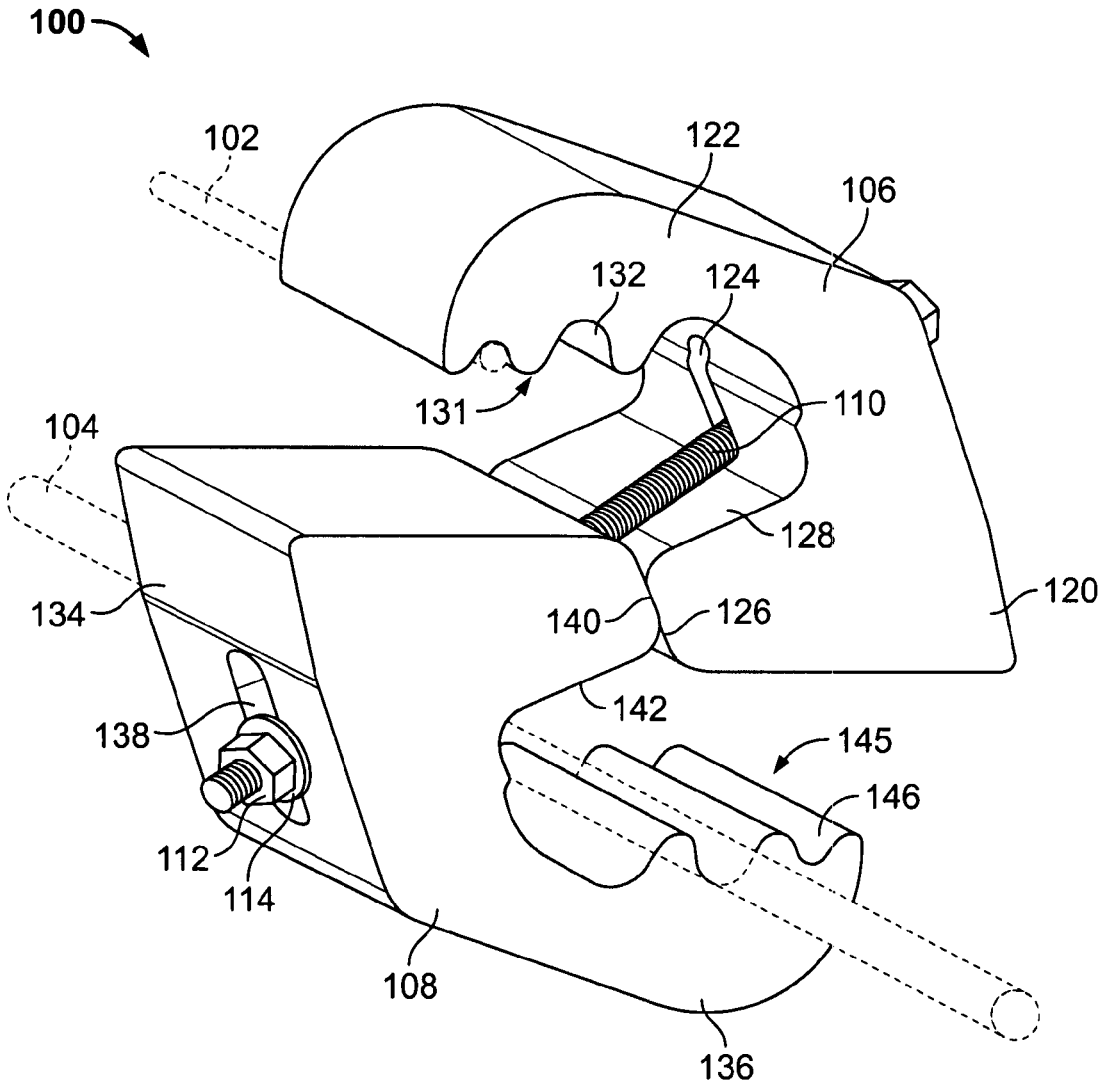
FIG. 5 illustrates the assembly shown in FIG. 4 in a partially mated position.
Figure 6:
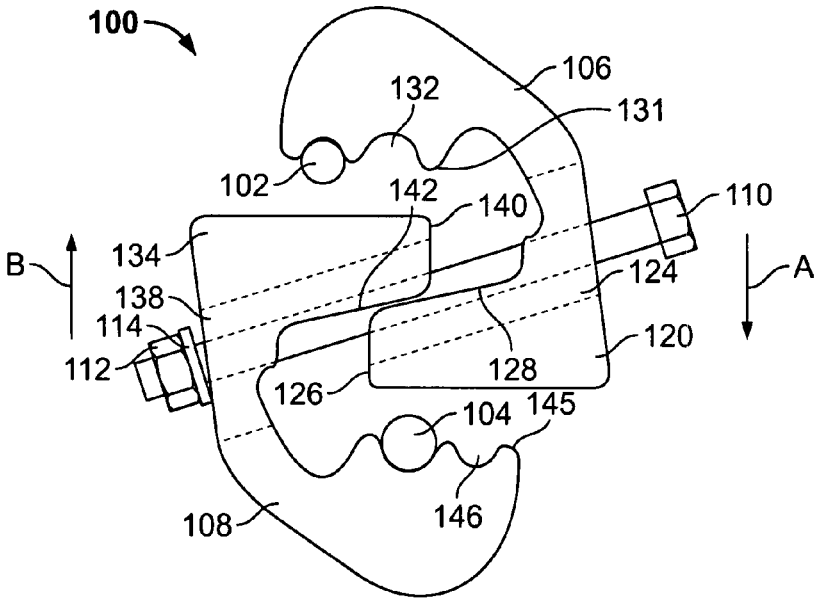
FIG. 6 is a cross sectional view of the assembly shown in FIG. 4 in a partially mated position.
Figure 7:
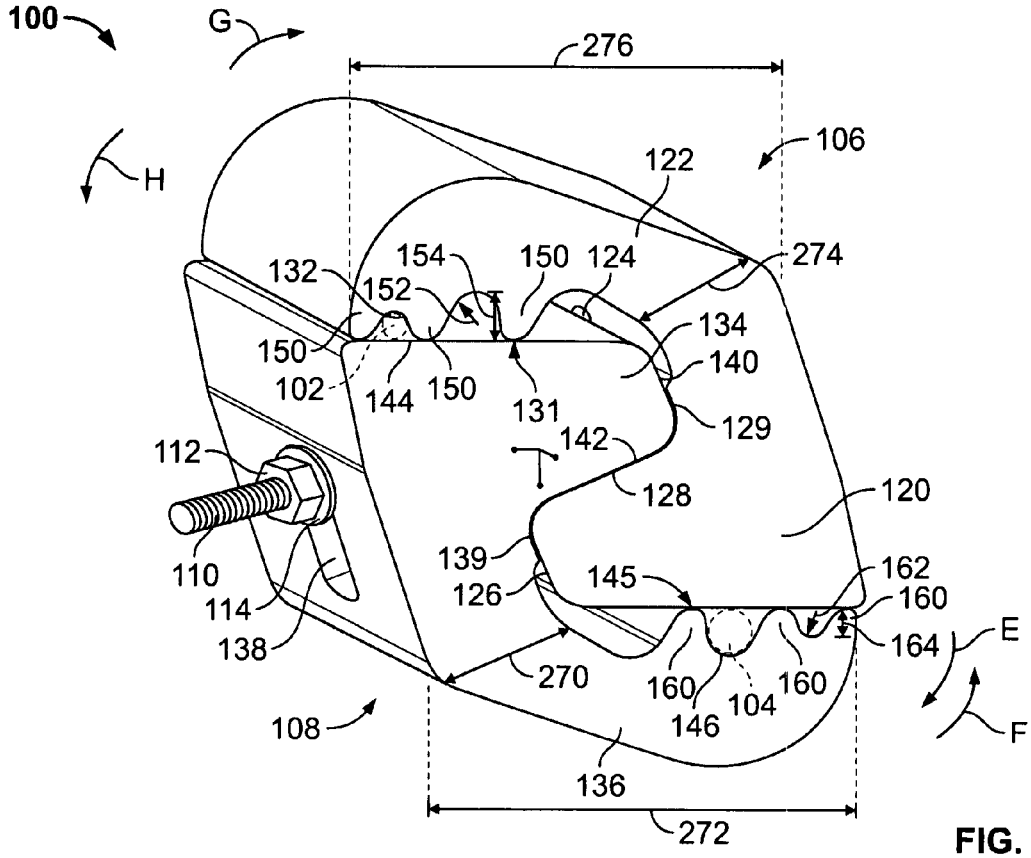
FIG. 7 illustrates the assembly shown in FIG. 4 in a mated position.

The assembly of the connector assembly 100 may be understood with reference to FIGS. 4-7. As indicated above, FIG. 4 illustrates the connector assembly 100 in an unmated position. FIG. 5 illustrates the connector assembly 100 in a partially mated position. FIG. 6 is a cross sectional view of the connector assembly 100 in another partially mated position. FIG. 7 illustrates the connector assembly 100 in a mated position.

During assembly, when the conductors 102, 104 are placed in, and cradled by, the respective channel portions 122, 136, and when the conductive member 106, 108 are coupled together by the fastener elements 110, 112, 114, the abutment faces 126, 140 are aligned in an unmated condition as shown in the perspective view in FIG. 5, and in the side elevational view in FIG. 6. The connector assembly 100 may be preassembled into the configuration shown in FIGS. 5 and 6, and the conductors 102 and 104 may be positioned within respective ones of the channels 132, 146 relatively easily. As seen in FIGS. 5 and 6, and because the opening of the fastener bores 124, 138 (shown in phantom in FIG. 6) are larger than an outer diameter of the fastener 110, the fastener 110 is positionable in a first angular orientation through the wedge portions 120 and 134.

As illustrated in FIGS. 5-7, the relative size of the fastener bores 124, 138 with respect to the fastener 110 permits the fastener 110 to float or move angularly with respect to an axis of the bores 124, 138 as the conductive members 106, 108 are moved to a fully mated position, which is illustrated in FIG. 7. More particularly, the abutment faces 126, 140 of the wedge portions 120, 134 are moved in sliding contact with one another in the directions of arrows A and B as shown in FIG. 5 until the wiping contact surfaces 128, 142 are brought into engagement as shown in FIG. 6, and the wedge portions 120, 124 may then be moved transversely into a nested or interfitted relationship as shown in FIG. 7 with the wiping contact surfaces 128, 132 in sliding engagement. All the while, and as demonstrated in FIGS. 5-7, the fastener 110 self adjusts its angular position with respect to the fastener bores as the fastener 110 moves from the initial position shown in FIG. 5 to a final position shown in FIG. 7. In the final, mated position, the fastener 110 extends obliquely to each of the fastener bores 124, 138, and the nut 112 may be tightened to the fastener 110 to secure the conductive members 106, 108 to one another.

FIG. 7 illustrates the connector assembly 100 in a fully mated position with the nut 112 tightened to the fastener 110. In the fully mated position, the tap and main conductive members 106, 108 cooperate to capture the tap and main conductors 102, 104. For example, the tap conductor 102 is positioned within, and cradled by, one of the channels 132 of the tap conductive member 106. The tap conductor 102 also engages, and makes direct electrical contact with, the conductor contact surface 144 of the main conductive member 108. As indicated above, a plurality of channels 132 are provided. The channels 132 are defined by fingers 150 separating the channels 132. The distal end of each finger 150 lies along and defines the mating interface 131.

In an exemplary embodiment, the channels 132 are each different and accommodate different sized tap conductors 102. For example, each of the channels 132 are generally arcuate between the respective fingers 150, and may have a different radius of curvature 152. A larger radius of curvature 152 accommodates larger gauged conductors. The radius of the tap conductor 102 is less than the radius of curvature 152 of the channel 132 such that the tap conductor 102 may be fully seated within the channel 132. Each of the channels 132 may have a different depth 154 measured from the mating interface 131, wherein deeper channels 132 accommodate larger gauged conductors. The diameter of the tap conductor 102 is greater than the depth 154 of the channel 132 such that the tap conductor 102 is at least partially exposed beyond the mating interface 131.

Each channel 132 may accommodate a range of conductor sizes. Optionally, the range of conductors that may be accommodated by a given channel 132 may be affected by the radius of curvature 152 of the channel 132, the depth 154 of the channel, the diameter of the conductor 102, the type of conductor 102, and the like. In the illustrated embodiment, the larger of the two channels may accommodate a 1 gauge to a 4/0 or four nought gauge tap conductor 102, while the smaller of the two channels 132 may accommodate a 6 gauge to a 2 gauge tap conductor 102. These ranges are illustrative only, and the ranges may accommodate more or less conductor sizes or may be shifted to accommodate a different range than indicated above. Additionally, more channels 132 may be provided to accommodate other ranges of tap conductors 102.

Likewise, the main conductor 104 is positioned within, and cradled by, one of the channels 146 of the main conductive member 108. The main conductor 104 also engages, and makes direct electrical contact with, the conductor contact surface 130 of the tap conductive member 106. As indicated above, a plurality of channels 146 are provided. The channels 146 are defined by fingers 160 separating the channels 146. The distal end of each finger 160 lies along and defines the mating interface 145.

In an exemplary embodiment, the channels 146 are each different and accommodate different sized main conductors 104. For example, each of the channels 146 are generally arcuate between the respective fingers 160, and may have a different radius of curvature 162. A larger radius of curvature 162 accommodates larger gauged conductors. The radius of the main conductor 104 is less than the radius of curvature 162 of the channel 146 such that the main conductor 104 may be fully seated within the channel 146. Each of the channels 146 may have a different depth 164 measured from the mating interface 145, wherein deeper channels 146 accommodate larger gauged conductors. The diameter of the main conductor 104 is greater than the depth 164 of the channel 146 such that the main conductor 104 is at least partially exposed beyond the mating interface 145.

Each channel 146 may accommodate a range of conductor sizes. As indicated above, the channel portion 136 of the main conductive member 108 may be substantially similar to the channel portion 122 of the tap conductive member 108, and thus may have the same sized and shaped channels 146. However, the channels 146 may be differently sized and/or shaped than the channels 132 and may accommodate a different range of conductor sizes.

During assembly, as the conductive members 106, 108 are moved through the positions shown in FIGS. 5-7, the wiping contact surfaces 128, 142 slidably engage one another and provide a wiping contact interface that ensures adequate electrically connectivity. The angled wiping contact surfaces 128, 142 provide a ramped contact interface that displaces the conductor contact surfaces 130, 144 in opposite directions indicated by arrows A and B as the wiping contact surfaces 128, 142 are engaged. In addition, the conductor contact surfaces 130, 144 provide wiping contact interfaces with the conductors 102 and 104 as the connector assembly 100 is installed.

Movement of the conductor contact surfaces 130, 144 in the opposite directions of arrows A and B clamps the conductors 102 and 104 between the wedge portions 120 and 134, and the opposing channel portions 122, 136. The mating interfaces 131, 145 of the channel portions 122, 136 are brought in close proximity to, and possibly abutting contact with, the wedge portions 120, 134 to the mated position, such as the position shown in FIG. 7. In the mated position, the conductive members 106, 108 substantially enclose portions of the conductors 102, 104 within the connector assembly 100. In one embodiment, the abutment faces 126, 140 of the wedge portions 120, 134 contact the displacement stops 125, 139 of the opposing conductive members 108 and 106 when the connector assembly 100 is fully mated. In such a position, the wedge portions 120, 134 are nested or mated with one another in an interfitting relationship with the wiping contact surfaces 128 and 142, the abutment faces 126 and 140, and the channel portions 122 and 136 providing multiple points of mechanical and electrical contact to ensure electrical connectivity between the conductive members 106 and 108.

In the fully mated position, such as the position shown in FIG. 7, the main conductor 104 is captured between the channel portion 136 of the main conductive member 108 and the conductor contact surface 130 of the tap conductive member wedge portion 120. Likewise, the tap conductor 102 is captured between the channel portion 122 of the tap conductive member 106 and the conductor contact surface 144 of the main conductive member wedge portion 134. As the wedge portion 120 engages the tap conductive member 106 and clamps the main conductor 104 against the channel portion 136 of the main conductive member 108, the channel portion 136 is deflected in the direction of arrow E. The channel portion 136 is elastically and plastically deflected in a radial direction indicated by arrow E, resulting in a spring back force in the direction of arrow F, opposite to the direction of arrow E, to provide a clamping force on the conductor 104. The amount of deflection, and the amount of clamping force, may be affected by a thickness 270 of the channel portion 136, a length 272 of the channel portion 136, the type of material of the main conductive member 108, and the like. A large contact force, on the order of about 4000 lbs is provided in an exemplary embodiment, and the clamping force ensures adequate electrical connectivity between the main conductor 104 and the connector assembly 100. Additionally, elastic spring back of the channel portion 136 provides some tolerance for deformation or compressibility of the main conductor 104 over time, because the channel portion 136 may effectively return in the direction of arrow F if the main conductor 104 deforms due to compression forces. Actual clamping forces may be lessened in such a condition, but not to such an amount as to compromise the integrity of the electrical connection. In an exemplary embodiment, the spring back allows a range of tolerance within the elastic range of the channel portion 136.

Likewise, the wedge portion 134 of the main conductive member 108 clamps the tap conductor 102 against the channel portion 122 of tap conductive member 106 and the channel portion 122 is deflected in the direction of arrow G. The channel portion 122 is elastically and plastically deflected in a radial direction indicated by arrow G, resulting in a spring back force in the direction of arrow H opposite to the direction of arrow G. The amount of deflection, and the amount of clamping force, may be affected by a thickness 274 of the channel portion 122, a length 276 of the channel portion 122, the type of material of the tap conductive member 106, and the like. A large contact force, on the order of about 4000 lbs is provided in an exemplary embodiment, and the clamping force ensures adequate electrical connectivity between the tap conductor 102 and the connector assembly 100. Additionally, elastic spring back of the channel portion 122 provides some tolerance for deformation or compressibility of the tap conductor 102 over time, because the channel portion 122 may simply return in the direction of arrow H if the tap conductor 102 deforms due to compression forces. Actual clamping forces may be lessened in such a condition, but not to such an amount as to compromise the integrity of the electrical connection.

Unlike known bolt connectors, torque requirements for tightening of the fastener 110 are not required to satisfactorily install the connector assembly 100. When the abutment faces 126, 140 of the wedge portions 120, 134 contact the channel portions 136, 122, the connector assembly 100 is fully mated. By virtue of the fastener elements 110, 112 and the combined wedge action of the wedge portions 120, 134 to deflect the channel portions 122, 136, the connector assembly 100 may be installed with hand tools, and specialized tooling, such as the explosive cartridge tooling of the AMPACT Connector system is avoided.

When fully mated, the abutment faces 126 and 140 may engage the displacement stops 139, 125, respectively, which define and limit a final displacement relation between the tap and main conductive members 106, 108. The displacement stops 125, 139 define a final mating position between the tap and main conductive members 106 and 108 independent of an amount of force induced upon the main and tap conductors 104, 102 by the main and tap conductive members 108 and 106. In an alternative embodiment, the abutment faces 126, 130 may be positioned a distance from the displacement stops 125, 139 in the final mating position.

Optionally, the displacement stops 125, 139 may be created from a stand off provided on one or both of the main and tap conductive members 108 and 106. For example, the stand off may be positioned proximate the central body portion 116 and extend outward therefrom. The stand off provides a gap between the channel portions 122, 136 and the wedge portions 134, 120, respectively, which allows the channel portions 122, 136 to flex and/or move without engaging the abutment faces 140, 126 of the respective wedge portions 134, 120. Alternatively, the displacement stops 125, 139 may be created as mating notches provided in the wiping contact surfaces 128 and 142, where the notches engage one another to limit a range of travel of the main and tap conductive members 108 and 106 toward one another.

The displacement stops 125, 139 allows the nut 112 and fastener 110 to be continuously tightened until the abutment faces 126, 140 fully seat against the channel portions 136, 122, independent of, and without regard for, any normal forces created by the tap and main conductors 102, 104. The contact forces are created by interference between the channel portions 136, 122, and wedge portions 120, 134, and tap and main conductors 102, 104. It is not necessary to measure the bolt torque in the mating the connector assembly 100 as the connector assembly 100 is fully mated when the main and tap conductive members 106, 108 are joined to a predetermined position or relative displacement. In the fully mated condition, the interference between the conductors 102, 104 and the connector assembly 100 produces a contact force adequate to provide a good electrical connection.

It is recognized that effective clamping force on the conductors 102, 104 is dependent upon the geometry of the wedge portions, dimensions of the channel portions, and size of the conductors used with the connector assembly 100. Thus, with strategic selections of angles for the wiping contact surfaces 128, 142 for example, the thicknesses 274, 270 and lengths 276, 272 of the channel portions 122, 136, respectively, and the size and positioning of the conductors 102, 104, varying degrees of clamping force may be realized when the conductive members 106 and 108 are used in combination as described above.

Because of the plurality of channels 132, 146 within the channel portions 122, 136, the conductive members 106 and 108 may accommodate a greater range of conductor sizes or gauges in comparison to conventional connectors. Additionally, even if several versions of the conductive members 106 and 108 are provided for installation to different conductor wire sizes or gauges, the assembly 100 requires a smaller inventory of parts in comparison to conventional bolt-on connectors and to conventional wedge connector systems, for example, to accommodate a full range of installations in the field. That is, a relatively small family of connector parts having similarly sized and shaped wedge portions may effectively replace a much larger family of parts known to conventional wedge connector systems.

It is therefore believed that the connector assembly 100 provides the performance of conventional wedge connector systems in a lower cost connector assembly that does not require specialized tooling and a large inventory of parts to meet installation needs. Using low cost extrusion fabrication processes and known fasteners, the connector assembly 100 may be provided at low cost, while providing increased repeatability and reliability as the connector assembly 100 is installed and used. The combination wedge action of the conductive members 106 and 107 provides a reliable and consistent clamping force on the conductors 102 and 104 and is less subject to variability of clamping force when installed than either of known bolt-on or compression-type connector systems.

Figure 8:
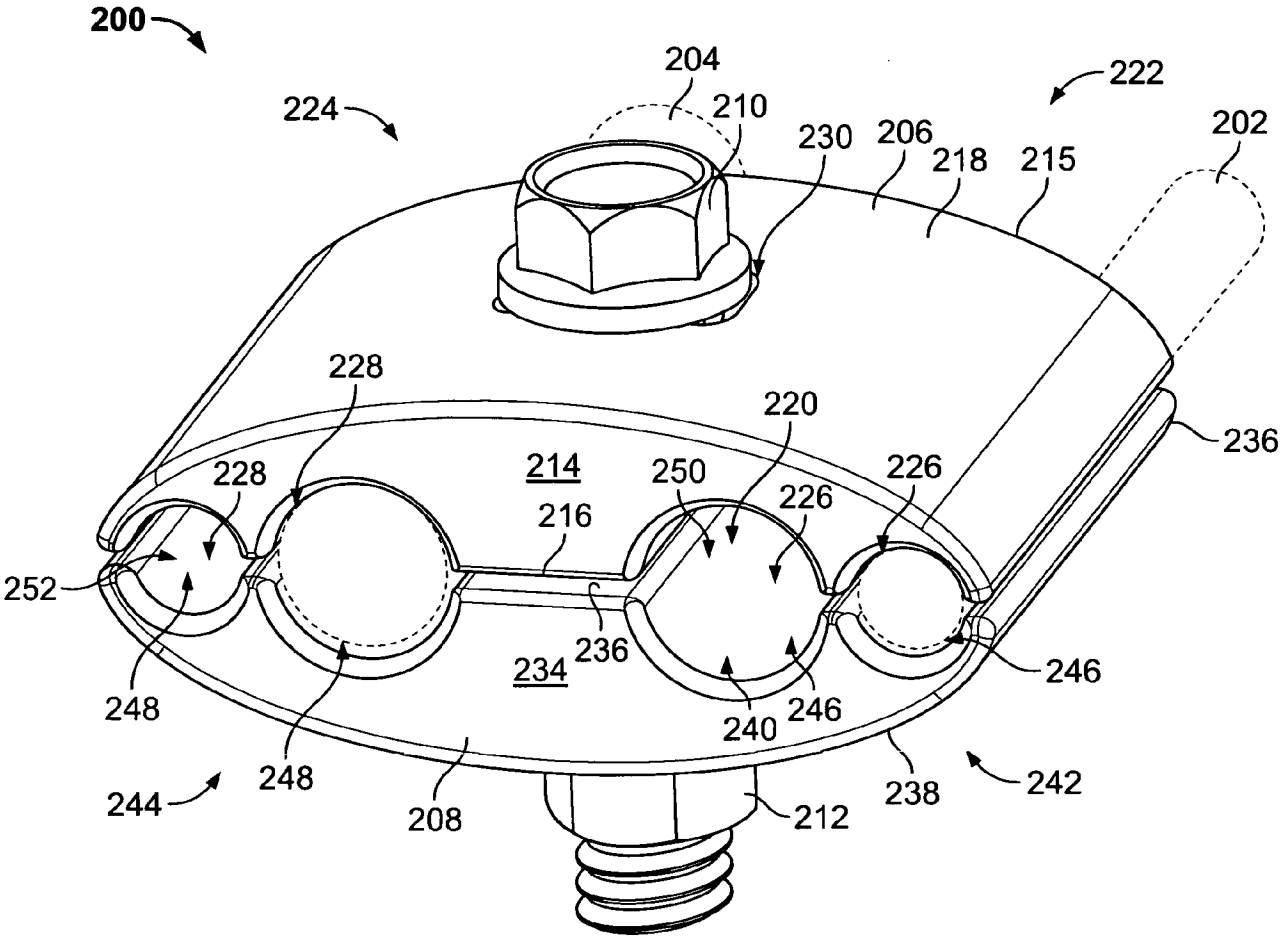
FIG. 8 illustrates another connector assembly formed in accordance with another exemplary embodiment.

FIG. 8 illustrates another connector assembly 200 formed in accordance with another exemplary embodiment. The connector assembly 200 is a bolt-on type of connector adapted for use as a tap connector for connecting a tap conductor 202 (shown in phantom in FIG. 4), to a main conductor 204 (also shown in FIG. 4) of a utility power distribution system. As explained in detail below, the connector assembly 200 provides greater range taking capability to known bolt-on connectors.

The connector assembly 200 includes a first conductive member 206 and a second conductive member 208 joined together by a fastener 210 and a nut 212. The first and second conductive members 206, 208 are substantially identically formed and cooperate to capture the tap and main conductors 202, 204 therebetween. Optionally, the first conductive member 206 may define a tap conductive member, and is adapted to support the tap conductor 202 during assembly of the connector assembly 200. The second conductive member 204 may define a main conductive member, and is adapted to support the main conductor 204 during assembly of the connector assembly. Alternatively, one of the conductive members may support both of the conductors 202, 204 during assembly.

The first conductive member 206 includes a front end 214 and a rear end 215 opposite the front end 214. The first conductive member 206 also includes a mating side 216 extending between the front and rear ends 214, 215 and an outer surface 218 also extending between the front and rear ends 214, 215. The mating side 216 is generally planar. A plurality of differently sized channels 220 extend into the body of the conductive member 206 from the mating side 216. The channels 220 are parallel to one another.

In an exemplary embodiment, one side of the first conductive member 206 defines a tap side 222 adapted to receive the tap conductor 202, while the other side of the first conductive member 206 defines a main side 224 adapted to receive the main conductor 204. A sub-set of the channels 220 define tap conductor channels 226, while another sub-set of the channels 220 define main conductor channels 228. The first conductive member 206 includes at least two tap conductor channels 226 and at least two main conductor channels 228.

The first conductive member 206 includes an opening 230 extending therethrough for receiving the fastener 210. The opening 230 extends between the outer surface 218 and the mating side 216.

The second conductive member 208 includes a front end 234 and a rear end 235 opposite the front end 234. The second conductive member 208 also includes a mating side 236 extending between the front and rear ends 234, 235 and an outer surface 238 also extending between the front and rear ends 234, 235. The mating side 236 is generally planar. A plurality of differently sized channels 240 extend into the body of the conductive member 208 from the mating side 236. The channels 240 are parallel to one another.

In an exemplary embodiment, one side of the second conductive member 208 defines a tap side 242 adapted to receive the tap conductor 202, while the other side of the second conductive member 208 defines a main side 244 adapted to receive the main conductor 204. A sub-set of the channels 240 define tap conductor channels 246, while another sub-set of the channels 240 define main conductor channels 248. The second conductive member 208 includes at least two tap conductor channels 246 and at least two main conductor channels 248.

The second conductive member 208 includes an opening (not shown) extending therethrough for receiving the fastener 210. The opening is substantially aligned with the opening 230 and extends between the outer surface 238 and the mating side 236.

When the first and second conductive members 206, 208 are joined to one another by the fastener 210, the conductive members 206, 208 are oriented such that the mating sides 216, 236 generally face one another. The channels 220 are substantially aligned with the channels 240. The tap conductor channels 226 cooperate with the main conductor channels 246 to define tap conductor bores 250. One of the tap conductor bores 250 receives the tap conductor 202. The selection of the bore 250 that receives the tap conductor 202 depends on the size and shape of the channels 226, 246 and/or the size and shape of the tap conductor 202. While two bores 250 are illustrated in FIG. 8, it is realized that any number of bores 250 may be provided in alternative embodiments. The channels 226, 246 are sized and shaped to cradle the tap conductor 202 and hold the tap conductor 202 in position during assembly of the connector assembly 100.

In an exemplary embodiment, the channels 226, 246 defining a first of the bores 250 are sized and/or shaped differently than the channels 226, 246 defining a second of the bores 250 to accommodate different sized and/or shaped tap conductors 202. Each channel 226, 246 includes an open side that receives the tap conductor 202 and exposes at least a portion of the tap conductor 202. For example, the channel 226 may wrap around the tap conductor 202 for about 180 circumferential degrees in an exemplary embodiment, and may expose about 180 circumferential degrees of the tap conductor 202. Similarly, the channel 246 may wrap around the tap conductor 202 for about 180 circumferential degrees in an exemplary embodiment, and may expose about 180 circumferential degrees of the tap conductor 202. The open side of each channel 226, 246 lies along the respective mating side 216, 236 and generally faces toward one another.

Each bore 250 may accommodate a range of conductor sizes. Optionally, the range of conductors that may be accommodated by a given bore 250 may be affected by a radius of curvature of the channels 226, 246, a depth of the channels 226, 246, a diameter of the conductor 202, a type of conductor 202, and the like. In the illustrated embodiment, the larger of the two bores 250 may accommodate a 1 gauge to a 4/0 or four nought gauge tap conductor 202, while the smaller of the two bores 250 may accommodate a 6 gauge to a 2 gauge tap conductor 102. These ranges are illustrative only, and the ranges may accommodate more or less conductor sizes or may be shifted to accommodate a different range than indicated above. Additionally, more bores 250 may be provided to accommodate other ranges of tap conductors 202.

Likewise, the main conductor channels 228 cooperate with the main conductor channels 248 to define main conductor bores 252. One of the main conductor bores 252 receives the main conductor 204. The selection of the bore 252 that receives the main conductor 204 depends on the size and shape of the channels 228, 248 and/or the size and shape of the main conductor 204. While two bores 252 are illustrated in FIG. 8, it is realized that any number of bores 252 may be provided in alternative embodiments, and the number of bores 252 may be more or less than the number of bores 250. The channels 228, 248 are sized and shaped to cradle the main conductor 204 and hold the main conductor 204 in position during assembly of the connector assembly 100.

In an exemplary embodiment, the channels 228, 248 defining a first of the bores 252 are sized and/or shaped differently than the channels 228, 248 defining a second of the bores 252 to accommodate different sized and/or shaped main conductors 204. Each channel 228, 248 includes an open side that receives the main conductor 204 and exposes at least a portion of the main conductor 204. For example, the channel 228 may wrap around the main conductor 204 for about 180 circumferential degrees in an exemplary embodiment, and may expose about 180 circumferential degrees of the main conductor 204. Similarly, the channel 248 may wrap around the main conductor 204 for about 180 circumferential degrees in an exemplary embodiment, and may expose about 180 circumferential degrees of the main conductor 204. The open side of each channel 228, 248 lies along the respective mating side 216, 236 and generally faces toward one another.

Each bore 252 may accommodate a range of conductor sizes. Optionally, the range of conductors that may be accommodated by a given bore 252 may be affected by a radius of curvature of the channels 228, 248, a depth of the channels 228, 248, a diameter of the conductor 204, a type of conductor 204, and the like. In the illustrated embodiment, the larger of the two bores 252 may accommodate a 1 gauge to a 4/0 or four nought gauge main conductor 204, while the smaller of the two bores 252 may accommodate a 6 gauge to a 2 gauge main conductor 204. These ranges are illustrative only, and the ranges may accommodate more or less conductor sizes or may be shifted to accommodate a different range than indicated above. Additionally, more bores 252 may be provided to accommodate other ranges of main conductors 204.

During assembly, the tap conductor 202 is loaded into the tap conductor channel 228 and the main conductor 204 is loaded into the main conductor channel 246. Alternatively, both conductors 202, 204 may be loaded into either the channels 226, 228 of the first conductive member 206, or both conductors 202, 204 may be loaded into either the channels 246, 248 of the second conductive member 208. The first and second conductive members 206, 208 are aligned with one another and mated with one another using the fastener 210. During tightening of the fastener 210, the conductive members 206, 208 are moved generally toward one another and the conductors 202, 204 are captured within the respective bores 250, 252 created by the channels of the conductive members 206, 208. In an exemplary embodiment, a gap is provided between the mating sides 216, 236 when the connector assembly 200 is fully assembled such that all of the forces imparted by the fastener 210 to the conductive members 206, 208 is transferred to the conductors 202, 204.

Because of the plurality of bores 250, 252, the conductive members 206 and 208 may accommodate a greater range of conductor sizes or gauges in comparison to conventional bolt-on connectors. Additionally, even if several versions of the conductive members 206 and 208 are provided for installation to different conductor wire sizes or gauges, the assembly 200 requires a smaller inventory of parts in comparison to conventional bolt-on connectors and to conventional wedge connector systems, for example, to accommodate a full range of installations in the field. That is, a relatively small family of connector parts having similarly sized and shaped wedge portions may effectively replace a much larger family of parts known to conventional wedge connector systems.

While the above described embodiments have been described with respect to transverse wedge type connectors and parallel groove type connectors, it is realized that the invention may be practiced in other types of connectors, such as, but in no way limited to, vice connectors, clam-shell type connectors, wedge connectors including bolt driven wedge connectors and fired wedge connectors, compression connectors, and the like. The connectors may include one, two or even more components that are coupled together to securely interconnect the two conductors. The connector pieces may be joined by a bolted connection, or with another type of fastener, or the pieces may be coupled by other devices or methods, such as compression.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. An electrical connector assembly for power utility transmission conductors, the assembly comprising:

a first conductive member and a second conductive member separately fabricated from one another and cooperating to interconnect main and tap conductors, each of the first and second conductive members including a wedge portion and a deflectable channel portion extending from the wedge portion, wherein each wedge portion includes an abutment face, a wiping contact surface angled with respect to the abutment face, and a conductor contact surface extending substantially perpendicular to the abutment face, the main and tap conductors are configured to be captured between the respective channel portions and the conductor contact surfaces of the wedge portions;

the channel portion of the first conductive member having a plurality of differently sized conductor receiving channels configured for receiving the main conductor or the tap conductor, wherein one of the channels is selected to receive the conductor based on the diameter of the conductor;

the channel portion of the second conductive member having a conductor receiving channel configured for receiving the other of the main and tap conductors; and a fastener joining the main and tap conductive members to one another.

2. The assembly of claim 1, wherein the channel portion of the second conductive member has a plurality of differently sized conductor receiving channels configured for receiving one of the main conductor and the tap conductor, wherein one of the channels of the second conductive member is selected based on the diameter of the conductor that is received therein.

3. The assembly of claim 1, wherein the tap conductor is captured between the channel portion of the first conductive member and the wedge portion of the second conductive member when the first and second conductive members are joined, and wherein the main conductor is captured between the channel portion of the second conductive member and the wedge portion of the first conductive member when the first and second conductive members are joined.

4. The assembly of claim 1, wherein a first of the channels of the channel portion of the first conductive member has a different depth than a second of the channels of the channel portion of the first conductive member.

5. The assembly of claim 1, wherein each channel is adapted to engage conductors having a range of sizes.

6. The assembly of claim 1, wherein the wedge portion of the first conductive member is configured to nest with, and be secured to, the wedge portion of the second conductive member, and wherein the wedge portion of the second conductive member is configured to nest with, and be secured to, the wedge portion of the first conductive member.

7. The assembly of claim 1, wherein the channel portion of the first conductive member includes an inner surface facing the wedge portion of the first conductive member, each of the plurality of conductor receiving channels being arranged adjacent one another, and spaced apart, along the inner surface, each of the plurality of conductor receiving channels being open along the inner surface.

8. The assembly of claim 1, wherein the second wedge portion includes a substantially planar conductor contact surface, the conductor contact surface of the second wedge portion extending along an open side of each of the plurality of conductor receiving channels to capture the first conductor within the selected conductor receiving channel.

9. The assembly of claim 1, wherein the wedge portion of the first conductive member and the wedge portion of the second conductive member are adapted to co-nest with one another and be secured to one another once fully mated with the wedge portion of the first conductive member interfitting within a space defined between the wedge portion and the hook portion of the second conductive member and with the second wedge portion interfitting within a space defined between the wedge portion and the hook portion of the first conductive member.

10. An electrical connector assembly for power utility transmission conductors, the assembly comprising:

a first conductive member and a second conductive member separately fabricated from one another and cooperating to interconnect main and tap conductors, each of the first and second conductive members including a wedge portion and a deflectable channel portion extending from the wedge portion, wherein the wedge portions of the main and tap conductive members are substantially identically formed with one another and are in abutting contact and interfitting with one another;

the channel portion of the first conductive member having a plurality of differently sized conductor receiving channels configured for receiving the main conductor or the tap conductor, wherein one of the channels is selected to receive the conductor based on the diameter of the conductor;

the channel portion of the second conductive member having a conductor receiving channel configured for receiving the other of the main and tap conductors; and a fastener joining the main and tap conductive members to one another.

11. The assembly of claim 10, wherein the channel portion of the second conductive member has a plurality of differently sized conductor receiving channels configured for receiving one of the main conductor and the tap conductor, wherein one of the channels of the second conductive member is selected based on the diameter of the conductor that is received therein.

12. The assembly of claim 10, wherein the tap conductor is captured between the channel portion of the first conductive member and the wedge portion of the second conductive member when the first and second conductive members are joined, and wherein the main conductor is captured between the channel portion of the second conductive member and the wedge portion of the first conductive member when the first and second conductive members are joined.

13. The assembly of claim 10, wherein a first of the channels of the channel portion of the first conductive member has a different depth than a second of the channels of the channel portion of the first conductive member.

14. The assembly of claim 10, wherein the wedge portion of the first conductive member is configured to nest with, and be secured to, the wedge portion of the second conductive member, and wherein the wedge portion of the second conductive member is configured to nest with, and be secured to, the wedge portion of the first conductive member.

15. The assembly of claim 10, wherein each wedge portion includes an abutment face, a wiping contact surface angled with respect to the abutment face, and a conductor contact surface extending substantially perpendicular to the abutment face, the main and tap conductors are configured to be captured between the respective channel portions and the conductor contact surfaces of the wedge portions.

16. The assembly of claim 10, wherein the channel portion of the first conductive member includes an inner surface facing the wedge portion of the first conductive member, each of the plurality of conductor receiving channels being arranged adjacent one another, and spaced apart, along the inner surface, each of the plurality of conductor receiving channels being open along the inner surface.

17. An electrical connector assembly comprising:

a first conductive member comprising a first hook portion extending from a first wedge portion, the first hook portion adapted to extend at least partially circumferentially around a first conductor, the first hook portion including a plurality of differently sized conductor receiving channels configured for receiving the first conductor; and a second conductive member comprising a second hook portion extending from a second wedge portion, the second hook portion adapted to extend at least partially circumferentially around a second conductor, the second hook portion including a conductor receiving channel configured for receiving the second conductor;

wherein the first wedge portion and the second wedge portion are adapted to co-nest with one another and be secured to one another once fully mated with the first wedge portion interfitting within a space defined between the second wedge portion and the second hook portion and with the second wedge portion interfitting within a space defined between the first wedge portion and the first hook portion; and wherein the first hook portion and the second wedge portion cooperate to capture the first conductor when the first and second conductive members are mated, and wherein the second hook portion and the first wedge portion cooperate to capture the second conductor when the first and second conductive members are mated.

18. The assembly of claim 17, wherein the second wedge portion includes a substantially planar conductor contact surface, the conductor contact surface of the second wedge portion extending along an open side of each of the plurality of conductor receiving channels to capture the first conductor within the selected conductor receiving channel.

19. The assembly of claim 17, wherein the first wedge portion and the second wedge portion are substantially identically formed.

20. The assembly of claim 17, wherein each of the first and second wedge portions includes an abutment face, a wiping contact surface angled with respect to the abutment face, and a conductor contact surface extending substantially perpendicular to the abutment face, the first and second conductors are configured to be captured between the respective first and second hook portions and the conductor contact surfaces of the second and first wedge portions.

* * * * *